US005595514A

United States Patent [19]

Romano et al.

[11] Patent Number: 5,595,514

[45] Date of Patent: Jan. 21, 1997

[54] FEEDTHROUGH PIN AND PROCESS FOR ITS PREPARATION, AND ELECTRICAL FEEDTHROUGH MADE THEREWITH

[75] Inventors: Timothy S. Romano; Tom K. Evans; Gary B. Hughes, all of Goleta; Karl H. Neumann, Santa Barbara, all of Calif.

[73] Assignee: Santa Barbara Research Center, Goleta, Calif.

[21] Appl. No.: 277,560

[22] Filed: Jul. 19, 1994

[51] Int. Cl.[6] ..... H01R 13/03

[52] U.S. Cl. ..... 439/886; 439/935; 29/874

[58] Field of Search ..... 439/886, 887, 439/935, 611; 29/874, 878, 879, 880, 846; 174/151, 152, 900

[56] References Cited

U.S. PATENT DOCUMENTS

| | | | |
|---|---|---|---|
| 2,897,584 | 8/1959 | Schumpelt | 439/886 |
| 3,257,636 | 6/1966 | Horssen | 439/874 |
| 4,479,069 | 10/1984 | Miller | 439/85 |
| 4,657,337 | 4/1987 | Kyle | 439/887 |
| 5,221,874 | 6/1993 | Dayton | 439/611 |

FOREIGN PATENT DOCUMENTS

| | | | |
|---|---|---|---|
| 449408 | 1/1973 | U.S.S.R. | 439/887 |

*Primary Examiner*—Gary F. Paumen
*Assistant Examiner*—T. C. Patel
*Attorney, Agent, or Firm*—W. C. Schubert; W. K. Denson-Low

[57] ABSTRACT

A feedthrough (34) is formed of a feedthrough plate (44) having at least one bore (46) therethrough and a feedthrough pin (48) hermetically sealed into the bore (46). The feedthrough pin (48) includes an elongated pin (50) having an axis of elongation (52), a recess (54) in at least one end of the pin (50), the recess (54) extending parallel to the axis of elongation (52), and a gold coating (56) within the recess (54). There are preferably a plurality of bores (46) in the feedthrough plate (48) and a corresponding plurality of the feedthrough pins (48). The gold coatings (56) at the ends of the feedthrough pins (48) are desirably lapped to ensure coplanarity and a smooth surface finish especially suited for wire bonding or tab bonding.

19 Claims, 2 Drawing Sheets

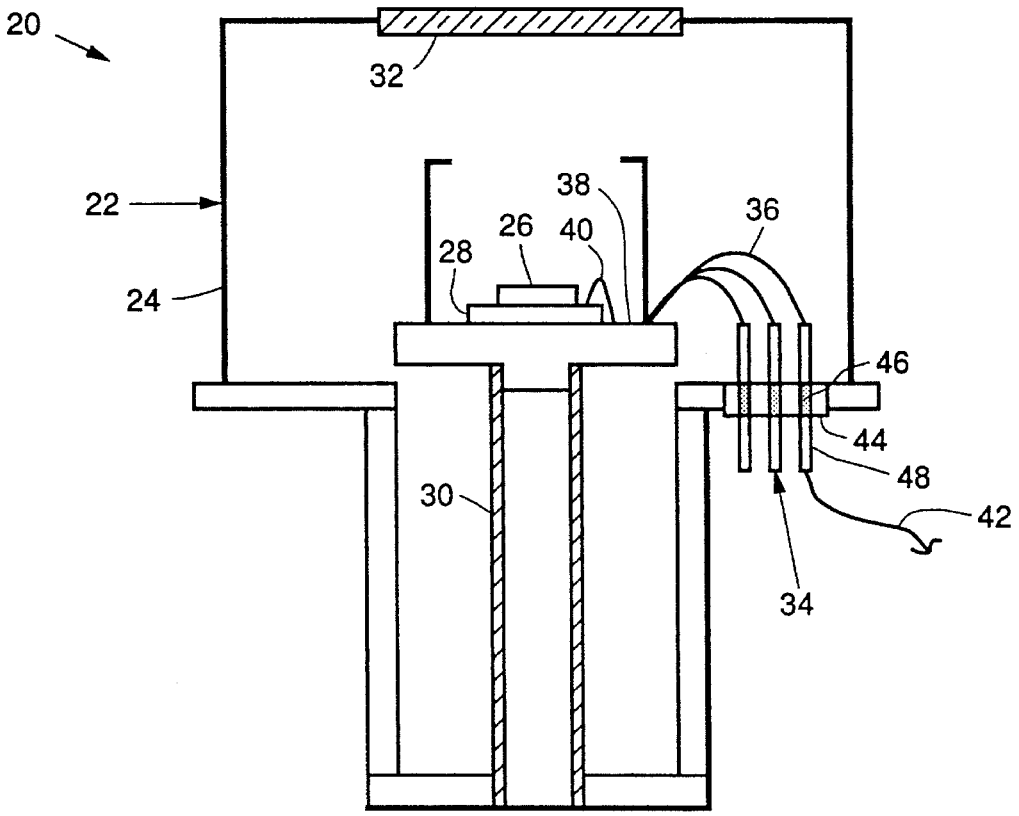
FIG. 1.
FIG. 2.
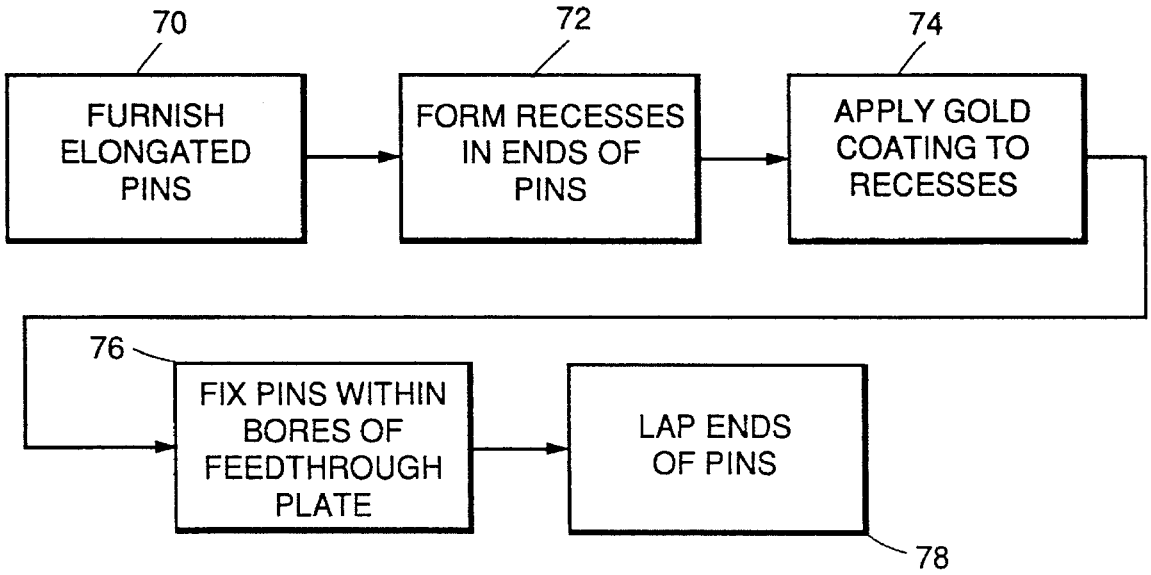

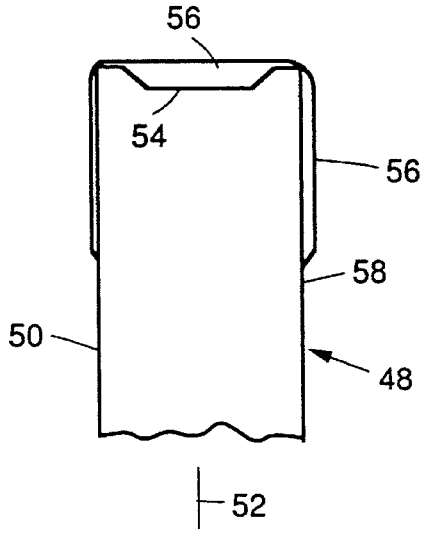
FIG. 3.
FIG. 4.
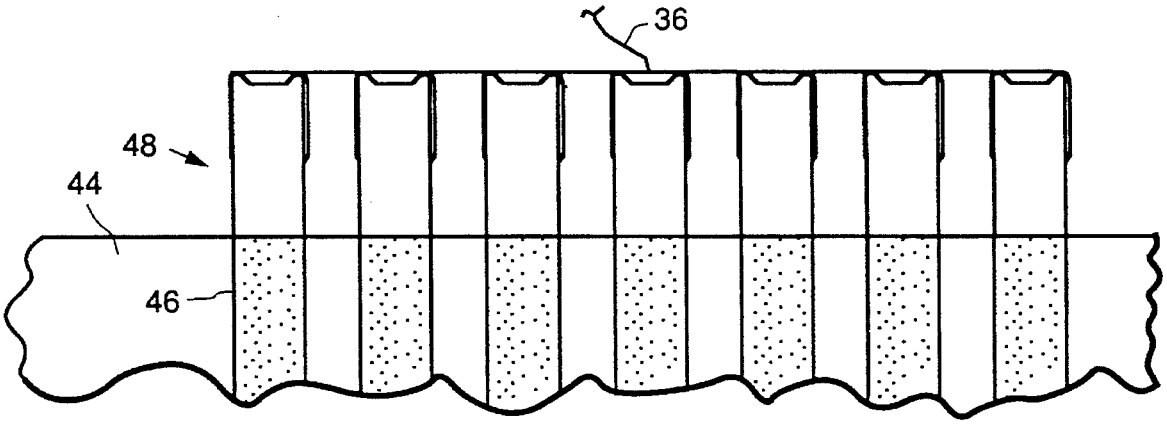

FEEDTHROUGH PIN AND PROCESS FOR ITS PREPARATION, AND ELECTRICAL FEEDTHROUGH MADE THEREWITH

BACKGROUND OF THE INVENTION

This invention relates to electrical feedthroughs, and, more particularly, for feedthrough pins utilized in the feedthroughs.

Many types of apparatus utilize an electrical feedthrough across a wall that separates two environments. The electrical feedthrough permits electrical signals and power to be conducted across the wall, but prevents any movement of mass, such as gas leakage, across the wall. As an example, an infrared sensor is typically contained in a vacuum enclosure. The sensor is cooled to cryogenic temperatures, typically about 77° K. or less. Output signals are conducted from the sensor to electronic devices located exterior to the vacuum enclosure, without losing the hermetic vacuum seal, via an electrical feedthrough in the wall of the enclosure.

The feedthrough is usually constructed with a plurality of feedthrough pins hermetically sealed in bores in a feedthrough plate made of an insulating material such as a ceramic. The feedthrough plate is hermetically sealed to the remainder of the wall of the package structure, here the vacuum enclosure. The ceramic insulator electrically isolates the feedthrough pins from the wall and from each other.

An electrical connection is made to each end of the feedthrough pin. In order to achieve a reliable, uniform connection to the feedthrough pins by techniques such as wire bonding or tab bonding, the ends of the set of feedthrough pins should be closely coplanar. The ends of the feedthrough pins should also have a good quality, smooth surface finish. In order to achieve coplanar, smooth ends of the feedthrough pins, the ends may be lapped or otherwise processed after the feedthrough pins are fixed to the feedthrough plate.

It is difficult to achieve the required coplanarity and surface finish on the ends of the feedthrough pins at the operation which bonds the pins to the plate, using conventional techniques. There is therefore a need for an improved approach to achieving coplanar, bondable feedthrough pins, and the feedthrough construction. The present invention fulfills this need, and further provides related advantages.

SUMMARY OF THE INVENTION

The present invention provides an electrical feedthrough pin that is particularly adapted to use in feedthroughs. The ends of the feedthrough pins of a feedthrough are readily brought into coplanarity. The ends may also be provided an excellent, smooth surface finish. The feedthrough pins have excellent connectability by wire bonding, tab bonding, or other techniques. The pins also have excellent mechanical properties and strength, and low electrical connection resistance. The feedthrough pins of the invertion are reliably made with little or no waste of the expensive gold coating material.

In accordance with the invention, a feedthrough pin comprises an elongated pin having an axis of elongation, a recess in at least one end of the pin, the recess extending parallel to the axis of elongation, and a coating of gold within the recess. An electrical feedthrough has a feedthrough plate having at least one bore therethrough, and a feedthrough pin hermetically sealed within the at least one bore of the feedthrough plate. The feedthrough pin has the structure just described.

The recess In the ends of the feedthrough pins aids in their being aligned and, where necessary, lapped to achieve good coplanarity and surface finish of the ends. Even after material is removed in the surface finishing and lapping process, a uniform end of each feedthrough pin is presented for external connection.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a schematic sectional view of a package structure utilizing an electrical feedthrough;

FIG. 2 is a process flow chart for the method of preparing the electrical feedthrough pins;

FIG. 3 is a schematic side sectional view of a portion of a feedthrough pin made according to the invention; and FIG. 4 is a schematic side sectional view of a portion of a set of feedthrough pins after the plns have been fixed to the feedthrough plate and the ends of the plns have been lapped.

DETAILED DESCRIPTION OF THE INVENTION

FIG. 1 depicts an apparatus 20 having a vacuum package enclosure 22 with a wall 24. Within the vacuum package enclosure 22 is a device 26, in this case an infrared sensor, that requires an electrical interconnection with electronic circuitry (not shown) external to the apparatus 20. The device 26 is mounted on a base 28, which in turn is mounted on a pedestal 30 that is attached to the interior of the vacuum package enclosure 22. The pedestal 30 and thence the device 26 are cooled by a Joule-Thomson cryostat or other cooling means (not shown) to a temperature that is typically about 77° K. or less. The device 26 faces forwardly through a window 32 which is supported in the wall 24.

In the assembled and operating form of the apparatus 20, the contained volume within the vacuum package enclosure 22 is evacuated. The wall 24 therefore separates an evacuated space from ambient air. An hermetic seal must be maintained between the interior of the vacuum package enclosure 22 and the exterior.

The apparatus 20 includes an electrical feedthrough 34. The feedthrough 34 provides a portion of the electrical connection path from the device 26 to the exterior of the apparatus 20. To connect from the feedthrough 34 to the device 26, there is a fine-wire internal lead 36 from the feedthrough 34 to a conductor trace 38 on the surface of the base 28, which in turn connects to another lead 40 that connects to the device 26. Exterior to the feedthrough 34, there is an external electrical connection, here shown to be a soldered lead 42, but which could be a permanent connector, a disconnectable connector, or any other suitable connection means.

The feedthrough 34 is formed of a generally flat feedthrough plate 44 of a ceramic material such as aluminum oxide. Bores 46 are formed through the feedthrough plate 36. Electrical feedthrough pins 48 are hermetically sealed into the bores 38.

The present invention is concerned with the structure of the feedthrough 34, and more particularly with the feedthrough pins 48. FIG. 2 depicts the process for preparing feedthrough pins 48 and their use in the feedthrough 34. FIG. 3 is an enlarged view of a single feedthrough pin 48 in accordance with the invention, and FIG. 4 shows a number of the feedthrough pins 48 fixed to the feedthrough plate 44.

Referring to FIGS. 2–3, elongated pins 50 having a pin axis 52 are furnished, numeral 70. The pins are preferably made of molybdenum. (As used herein, "molybdenum" includes either pure molybdenum or a molybdenum alloy.) In a typical case, the pins 50 are generally in the form of cylinders about 0.320 inches long and 0.018 inches in diameter.

A recess 54 is formed in at least one end of each pin 50, numeral 72. The recess 54 extends into the end of the pin 50 parallel to the pin axis 52. In the case of the 0.320 inch long, 0.018 inch diameter pin discussed above, the recess 54 is about 0.015+/–0.0025 inches deep, and has a diameter of about 0.010+/–0.0025 inches. The sides of the recess 54 are desirably angled inwardly to impart a cuplike shape to the recess 54.

A gold coating 56 is applied to the pin 50, numeral 74. The gold coating 56 is applied to fill the recess 54, and may also be applied overlying at least a portion of a longitudinal side 58 of the pin 50. The gold coating is produced by forming a slurry of about 90 parts by volume of fine gold particles, about 8 parts by volume of a binder such as acrylic binder solution, and about 2 parts by volume of a carrier such as acetone. The slurry is painted onto the pin 50 in the locations where a gold coating is desired. An advantage of this approach is that the slurry layer may be thick in the recess 54, to fill the recess, and thinner along the longitudinal sides of the pin. After the slurry is painted onto the pins 50, the slurry is allowed to dry. The slurry-coated pin is then heated to a temperature above the melting point of gold, preferably 2040° F., so that the binder burns away and the gold melts. The gold flows to even out any irregularities so that, after cooling, there is a smooth gold coating on the pins 50. The coating in this case is thicker in the interior of the recess 54 and thinner along the longitudinal sides 58 of the pins 50. Preferably, only those portions of the sides 58 of the pins 50 near the ends of the pins are coated with gold. The finished structures are the feedthrough pins 48.

The gold-coated feedthrough pins 48 are inserted into the bores 46 and hermetically fixed into the ceramic feedthrough plate 44, numeral 76. The feedthrough pins 48 may be fixed in place by any operable technique such as, for example, a glass seal, a ceramic seal, or active brazing. FIG. 4 shows a plurality of the feedthrough pins 48 fixed into place in the feedthrough plate 44.

After the feedthrough pins 48 are fixed in place, electrical connections may be made to the ends of the feedthrough pins 48. A lead 36 is bonded to the end of one of the feedthrough pins 48 in FIG. 4, for Illustration, but in practice there would be leads 36 bonded to the ends of most or all of the feedthrough pins 48.

Prior to the formation of the electrical connections, the ends of the feedthrough pins 48 may optionally be lapped, numeral 78, to cause the ends to be coplanar and provide the ends with a smooth finish that is beneficial in making the electrical connections. To perform the lapping operation, the feedthrough plate 44 is inverted over a lapping wheel or other surface, so that the ends of the feedthrough pins 48 contact the lapping surface. Material is lapped from the gold coating 56 overlying the recess 54. A sufficient amount of gold is removed so that all of the ends are coplanar and smooth. In trials of the invention, coplanarity within less than 0.0005 inches and a gold surface finish of less than 2 micrometers RMS variation have been achieved. Such results can be repeatably produced, which has not been possible in the absence of the recesses in the ends of the pins, because in the prior approach the gold is removed during the lapping operation. In the case of the present pin having the recess 54, even after lapping a gold layer remains for attachment of the leads 36.

With the ends of the feedthrough pins 48 made coplanar in this fashion, the leads 96 are readily wire bonded or tab bonded in a single automated operation. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A feedthrough pin, comprising:

an elongated pin having an axis of elongation;

a recess in at least one end of the pin, the recess extending parallel to the axis of elongation; and a coating of gold within the recess, the gold being present in an amount sufficient to fill the recess.

2. The feedthrough pin of claim 1, wherein the coating of gold has a lapped surface.

3. The feedthrough pin of claim 1, wherein the elongated pin is made of molybdenum.

4. The feedthrough pin of claim 1, wherein the recess has a depth of about 0.015 inches.

5. The feedthrough pin of claim 1, wherein the coating of gold extends outside of the recess and onto a lateral surface of the elongated pin.

6. The feedthrough pin of claim 1, wherein there is a recess in each end of the pin extending parallel to the axis of elongation, and a coating of gold within each recess.

7. A feedthrough, comprising:

a feedthrough plate having at least one bore therethrough; and a feedthrough pin hermetically sealed in the at least one bore of the feedthrough plate, the feedthrough pin comprising an elongated pin having an axis of elongation, a recess in at least one end of the pin, the recess extending parallel to the axis of elongation, and a coating of gold within the recess, the gold being present in an amount sufficient to fill the recess.

8. The feedthrough of claim 7, wherein the coating of gold has a lapped surface.

9. The feedthrough of claim 7, wherein the elongated pin is made of molybdenum.

10. The feedthrough of claim 7, wherein the recess has a depth of about 0.015 inches.

11. The feedthrough of claim 7, wherein the coating of gold extends outside of the recess and onto a lateral surface of the elongated pin.

12. The feedthrough of claim 7, wherein there is a recess in each end of the pin extending parallel to the axis of elongation, and a coating of gold within each recess.

13. The feedthrough of claim 7, wherein there are a plurality of bores in the feedthrough plate, and wherein there is a feedthrough pin sealed into each of the bores, each feedthrough pin comprising an elongated pin having an axis of elongation, a recess in at least one end of the pin, the recess extending parallel to the axis of elongation, and a coating of gold within the recess, the gold being present in an amount sufficient to fill the recess.

14. The feedthrough of claim 13, wherein the coating of gold on each feedthrough pin has a lapped surface, and wherein the lapped surfaces of the plurality of feedthrough pins are coplanar.

15. A method for preparing a feedthrough pin, comprising the steps of furnishing an elongated pin having an axis of elongation;

forming a recess in at least one end of the pin, the recess extending parallel to the axis of elongation; and applying a coating of gold within the recess, the gold being present in an amount sufficient to fill the recess.

16. The method of claim 15, including the additional step, after the step of applying a coating of gold, of lapping the end of the pin to form a lapped surface on the coating of gold.

17. A feedthrough pin prepared by the process of claim 15.

18. The method of claim 15, wherein the step of applying a coating includes the step of furnishing a gold-containing slurry, applying the slurry to the recess, and heating the slurry to a temperature above the melting point of gold.

19. A feedthrough, comprising:

a feedthrough plate having a plurality of bores therethrough; and a feedthrough pin hermetically sealed in each of the plurality of bores, each feedthrough pin comprising an elongated pin having an axis of elongation, a recess in an end of the pin, the recess extending parallel to the axis of elongation, and a coating of gold within the recess and having an exposed surface, the gold being present in an amount sufficient to fill the recess, wherein the exposed surfaces of the gold coatings of the plurality of feedthrough pins are coplanar.

* * * * *